US009474353B2

(12) United States Patent
Fontaine

(10) Patent No.: US 9,474,353 B2
(45) Date of Patent: Oct. 25, 2016

(54) DUAL APPLICATOR FOR APPLYING A PRODUCT TO THE EYELASHES

(75) Inventor: Michel Fontaine, Paris (FR)

(73) Assignee: L'OREAL, Paris (FR)

( * ) Notice: Subject to any disclaimer, the term of this patent is extended or adjusted under 35 U.S.C. 154(b) by 369 days.

(21) Appl. No.: 13/643,343

(22) PCT Filed: Apr. 6, 2011

(86) PCT No.: PCT/EP2011/055373

§ 371 (c)(1),
(2), (4) Date: Apr. 16, 2013

(87) PCT Pub. No.: WO2011/124620

PCT Pub. Date: Oct. 13, 2011

(65) Prior Publication Data

US 2013/0195539 A1 Aug. 1, 2013

Related U.S. Application Data

(60) Provisional application No. 61/323,631, filed on Apr. 13, 2010.

(30) Foreign Application Priority Data

Apr. 6, 2010 (FR) ..... 1052582

(51) Int. Cl.
*A46B 11/00* (2006.01)
*A45D 40/26* (2006.01)
(Continued)

(52) U.S. Cl.
CPC ..... *A45D 40/265* (2013.01); *A45D 40/262* (2013.01); *A46B 3/18* (2013.01); *A46B 9/021* (2013.01); *A46B 2200/1053* (2013.01)

(58) Field of Classification Search
CPC ..... A46B 2200/1053; A46B 9/021
USPC ..... 401/126–130; 132/218
See application file for complete search history.

(56) References Cited

U.S. PATENT DOCUMENTS 4,887,622 A 12/1989 Gueret
4,964,429 A * 10/1990 Cole ..... A45D 40/265 132/216
5,357,987 A * 10/1994 Schrepf ..... A45D 34/042 132/218

(Continued)

FOREIGN PATENT DOCUMENTS

FR 2922422 4/2009
WO 2007125207 11/2007

(Continued)

OTHER PUBLICATIONS

International Search Report for corresponding International Application No. PCT/EP2011/055373, dated Jun. 8, 2011.

(Continued)

*Primary Examiner* — Jennifer C Chiang
(74) *Attorney, Agent, or Firm* — The Marbury Law Group, PLLC

(57) ABSTRACT

Applicator (1) for applying a product to the eyelashes, comprising a core (7), comprising two arms that are twisted together along at least part of their length, the core successively holding by clamping a first applicator member (5), produced in one piece and having a plurality of applicator elements, and a second applicator member (6) comprising a plurality of bristles.

9 Claims, 3 Drawing Sheets

(51) Int. Cl.

| | |
|---|---|
| ***A46B 3/18*** | (2006.01) |
| ***A46B 9/02*** | (2006.01) |

(56) References Cited

U.S. PATENT DOCUMENTS

| | | | | |
|---|---|---|---|---|
| 6,067,997 | A | 5/2000 | Gueret | |
| 6,394,678 | B2 * | 5/2002 | Schrepf | A46B 3/18 15/114 |
| 6,408,857 | B1 * | 6/2002 | Neuner | 132/218 |
| 8,408,218 | B2 * | 4/2013 | Anderson | A45D 40/18 132/218 |
| 8,783,268 | B2 * | 7/2014 | Gueret | A45D 40/265 132/218 |
| 8,783,989 | B2 * | 7/2014 | Weigel | A45D 40/24 132/218 |
| 8,826,923 | B2 * | 9/2014 | Caulier | 132/218 |
| 8,920,058 | B2 * | 12/2014 | Simard | A46B 9/005 132/218 |
| 2003/0084913 | A1 | 5/2003 | Gueret | |
| 2006/0162736 | A1 * | 7/2006 | Gray | A45D 40/262 132/218 |
| 2007/0204874 | A1 | 9/2007 | Kim | |
| 2008/0245382 | A1 | 10/2008 | Marciniak-Davoult et al. | |
| 2009/0083925 | A1 | 4/2009 | Mathiez | |
| 2009/0139535 | A2 | 6/2009 | Gueret | |
| 2009/0194128 | A1 | 8/2009 | Vandromme | |
| 2009/0214284 | A1 | 8/2009 | Gueret | |
| 2009/0320872 | A1 | 12/2009 | Vandromme | |
| 2010/0310296 | A1 | 12/2010 | Gueret | |
| 2011/0030718 | A1 * | 2/2011 | Gueret | 132/218 |
| 2011/0048448 | A1 * | 3/2011 | Legassie | A45D 40/267 132/218 |
| 2011/0083694 | A1 * | 4/2011 | Priore | A46B 9/021 132/218 |
| 2013/0104925 | A1 * | 5/2013 | Caulier | 132/218 |

FOREIGN PATENT DOCUMENTS

| | | |
|---|---|---|
| WO | 2009153753 | 12/2009 |
| WO | 2009153761 | 12/2009 |

OTHER PUBLICATIONS

Written Opinion for corresponding International Application No. PCT/EP2011/055373, dated Jun. 8, 2011.

English translation of Written Opinion for corresponding International Application No. PCT/EP2011/055373, dated Jun. 8, 2011.

* cited by examiner

DUAL APPLICATOR FOR APPLYING A PRODUCT TO THE EYELASHES

The present invention relates to an applicator for applying a cosmetic product to the eyelashes.

The expression "cosmetic product" is understood to mean any composition as defined in Council Directive 93/35/EEC of 14 Jun. 1993.

Most of the applicators, known from the prior art, for applying a product to the eyelashes and commonly known as "mascara brushes" are obtained by an industrial process in which a set of independent bristles are arranged between the two arms of a U-shaped metal pin, said bristles being arranged approximately alongside one another along the length of the interstitial space separating the two arms of the pin. A torsional force is then applied to the pin, causing it to be twisted. The twisting of the pin itself causes the bristles to be trapped between the arms and also causes helical expansion of these bristles, which adopt a distribution in helical layers. The production of such an applicator is described in particular in document U.S. Pat. No. 4,887,622.

Thus, an applicator head, which is fitted onto a stem that extends from a gripping member, in the continuation of said stem, is obtained. Such a gripping member is generally designed to form a means for closing a container that contains the product to be applied by means of this applicator head.

These prior-art mascara brushes are generally satisfactory. However, these brushes nevertheless have a certain number of drawbacks.

Application WO 2007/125207 describes another type of mascara brush having an applicator with a curved core in the form of a pin, onto which there are threaded a plurality of kernels that carry applicator elements in the form of protuberances extending from the kernel. The two arms of the core are then twisted such that the applicator elements form helical layers. With such an applicator, the user has only one type of applicator element.

There is a need to further improve applicators, in particular to allow the user to carry out various actions on the eyelashes with the aid of one and the same applicator. There is likewise a need for applicators which exhibit behaviour during wiping, on being removed from the container into which they have been dipped in order to be loaded with cosmetic product, which allows optimal loading with product along the entire applicator: neither too much nor too little.

It is likewise desirable to be able to benefit from an applicator that affords new possibilities in terms of the orientation and nature of the applicator elements, for example in order to obtain different makeup results or to improve an application of makeup. In particular, there is a need to improve the configuration of the end of mascara brushes which structurally have few bristles when they are obtained by the twisting of a pin. The free distal end of a brush according to the invention can be used to remedy this defect.

Another object of the invention is to provide a new applicator which has a particularly simple and inexpensive structure, the construction and manufacture of which are based on generally simple and proven technical principles, and which is adjustable into a large number of variants, while making it possible to obtain an improved makeup result and/or excellent ease of use.

The aim of the invention is to meet some or all of these needs and it achieves this aim, according to one of its aspects, by way of an applicator for applying a product to the eyelashes, comprising a core, comprising two arms that are twisted together along at least part of their length, the core successively holding by clamping a first applicator member, produced in one piece and having a plurality of applicator elements, and a second applicator member comprising a plurality of bristles.

While remaining within the field of the invention, the two twisted arms may be replaced by any twisting means that is able to impart twisting to at least one of the first and/or second applicator members.

For example, the first applicator member may comprise a body and said applicator elements extending from this body, such that the applicator elements extend in at least two, preferably at least three, separate radial directions in relation to the body, prior to insertion into the core.

Advantageously, for at least one radial direction, at least one applicator element, may extend in the region of, or even beyond, a free end of the core. In particular, a foot for connecting this applicator element to the body may be located in the region of, or even beyond, the free end of the core. In particular, when the core is obtained by the folding of one and the same strand on itself so as to form two arms, the bend formed in this strand constitutes the distal end of the core.

In particular, said applicator elements may expand helically on account of the twisting of the core about this first applicator member.

For example, the degree of twisting of the core may vary along the length of the latter.

The first applicator member may be produced by injection-moulding thermoplastic material, which is or is not a thermoplastic elastomer, or an elastomer other than a thermoplastic elastomer, or else by casting a resin.

A further subject of the invention is a packaging and application device that comprises:

- an applicator according to the invention, and
- a cosmetic product to be applied to the eyelashes, in particular mascara.

The applicator may be held by a proximal end at the end of a stem of the device such that the first applicator element is located in the region of a distal end, opposite the proximal end, of the applicator in relation to a longitudinal axis of the applicator. Thus, the first applicator member may allow a fine makeup result at the corner of the eye, since its positioning may make it possible to avoid excessive loading of product in the region of the distal end of the applicator.

In particular, such a device may have a container provided with a wiper for cooperating with the applicator and regulating the load of cosmetic product thereon, whether this be in the region of the first applicator member or in the region of the second applicator member. This same wiper may also cooperate with said stem in order to clean it when it is removed from the container.

Another subject of the invention is a method for manufacturing an applicator according to the invention, comprising the steps of:

- presenting the non-twisted arms of the core,
- providing the first and the second applicator member on at least one of the arms, successively along the longitudinal axis of this arm,
- twisting the core in order to bring about spiralling of the arms and spiralling of at least one of the first and the second applicator member.

When the first and the second applicator member are arranged in succession, prior to twisting, it is possible for there to be no axial covering, along the longitudinal axis of the arm, between these two applicator members.

For example, according to this method, the core may be twisted so as to bring about spiralling of the arms along the entire length where they enclose the first and the second applicator member.

Further advantages and subjects of the invention will become apparent in more detail from reading the following description and with the aid of the appended drawings, which are provided purely by way of nonlimiting example, and in which.

Figure 4A:
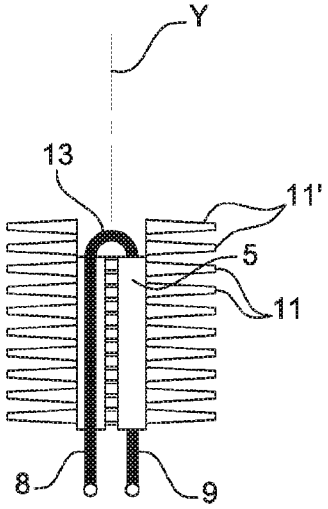
Figure 5:
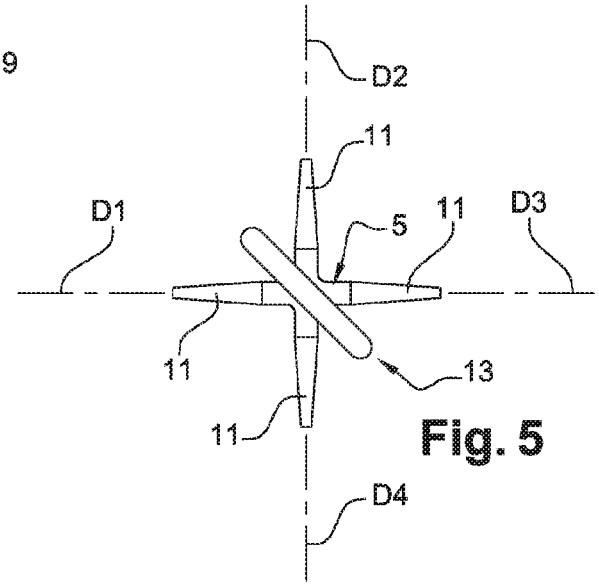
Figure 4B:
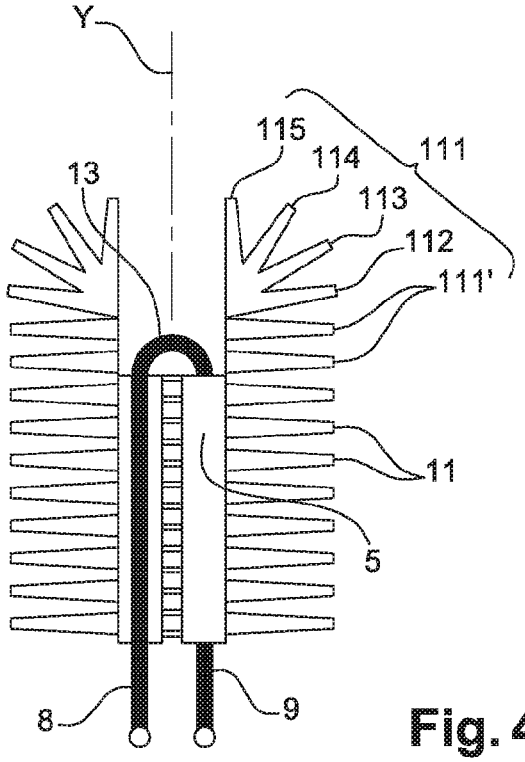

FIGS. 4*a* and 4*b* show partial profile views of applicator variants according to the invention during an intermediate step in their formation;

FIG. 5 shows a top view from a distal end of an applicator according to the invention during an intermediate step in its formation.

Figure 1:
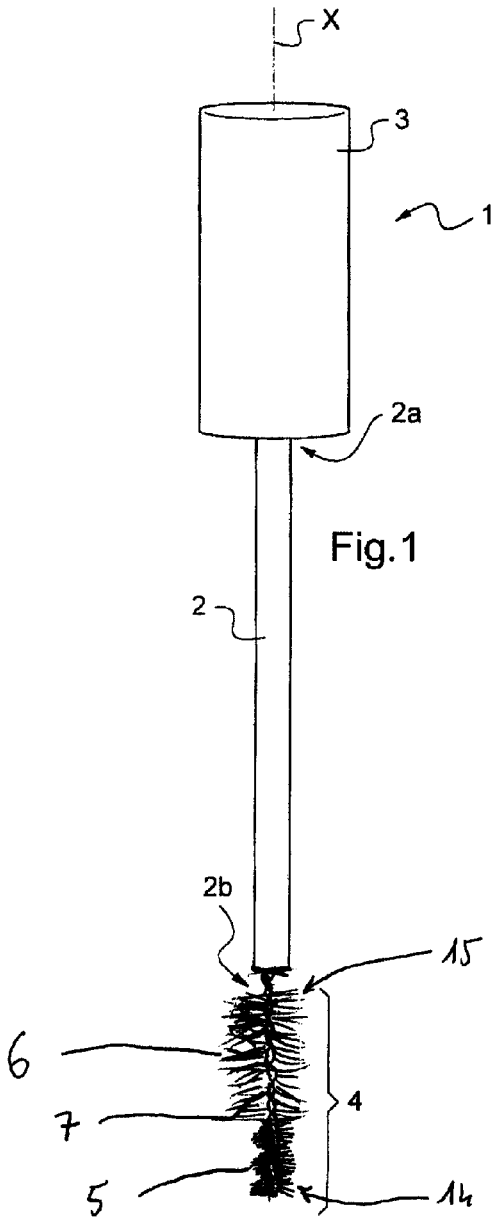
FIG. 1 shows a profile view of an applicator mounted at the end of a stem of an applicator device according to the invention.

FIG. 1 shows an applicator 1 according to a first embodiment of the invention. This applicator 1 comprises a stem 2 which carries an applicator head 4 and which may extend, as illustrated, in a substantially rectilinear manner along an axis X. Alternatively, the stem 2 may extend along a curved longitudinal axis.

The stem 2 is connected at a first end 2*a* to a gripping member 3, designed to be grasped and manipulated manually by a user, for example between two or three fingers. The applicator 1 thus has, in a conventional manner, a portable character and is intended for manual use.

The gripping member 3 is, for example, designed to be placed on a container, not shown, containing for example mascara, so as to close it in a sealed manner. The product to be applied may be liquid, semi-liquid, for example pasty, or else in the form of a powder. The gripping member may have a mounting skirt designed to be fixed on the container, for example to be screwed onto a neck of the container. The neck of the container may carry a wiper for the stem 2 and for the applicator head 4. The stem 2 may have a circular cross section, with or without a narrowing in the region of its portion that is positioned opposite the wiper. The stem 2 is connected, at a second end 2*b* opposite the first end 2*a*, to the applicator head 4.

The container may be provided with any type of member for wiping the stem and the applicator head, said wiping member being adjustable or not adjustable and having an elastomer lip which is or is not wave-shaped and is or is not split. The applicator head 4 may be connected to the stem 2 by an elastically deformable flexible portion.

The applicator may have a source of vibration, if need be, and/or be able to rotate and/or be heated.

The applicator head 4 may, as shown in FIG. 1, extend along a rectilinear longitudinal axis, coincident with the axis X of the stem. In variants which are not shown, the applicator head 4 extends along a longitudinal axis that extends obliquely with respect to the axis X of the stem 2. The applicator head 4 may also extend along a curve.

According to the invention, the applicator head 4 has a first applicator member 5 and a second applicator member 6. The applicator head 4 is designed to pick up product to be applied, for example by being dipped into a container that contains the product, and to hold and contain this quantity of picked-up product until it is released onto the eyelashes, this being carried out preferably by the applicator head 4 being brought into contact with and rubbed against the eyelashes. The applicator head coats the eyelashes with mascara and has a function of combing and separating the eyelashes.

The first and second applicator members may have different colours.

The bristles 10 of the second applicator members 6 are for example selected for their capacity to be loaded with product, being for example numerous and thin, or even flocked, while the applicator elements of the first applicator member 5 may be selected for their aptitude for separating the eyelashes on account of greater rigidity than the bristles.

Figure 2:
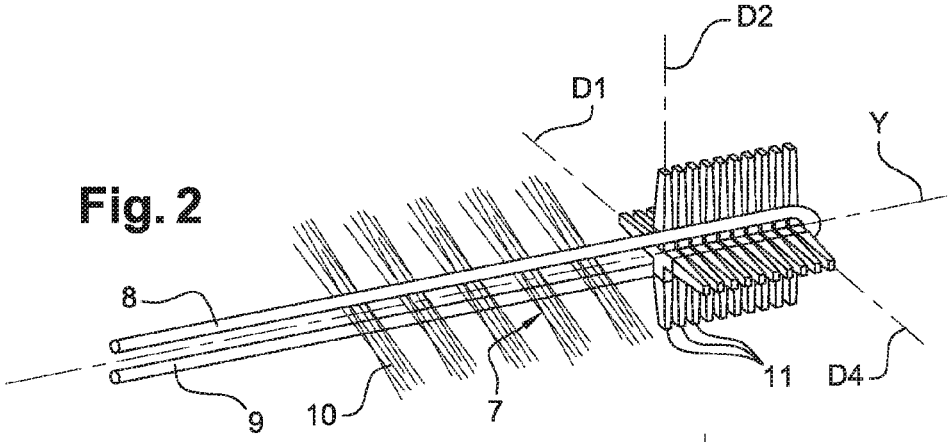
FIG. 2 shows a perspective view of an applicator according to the invention during an intermediate step in its formation.
Figure 3:
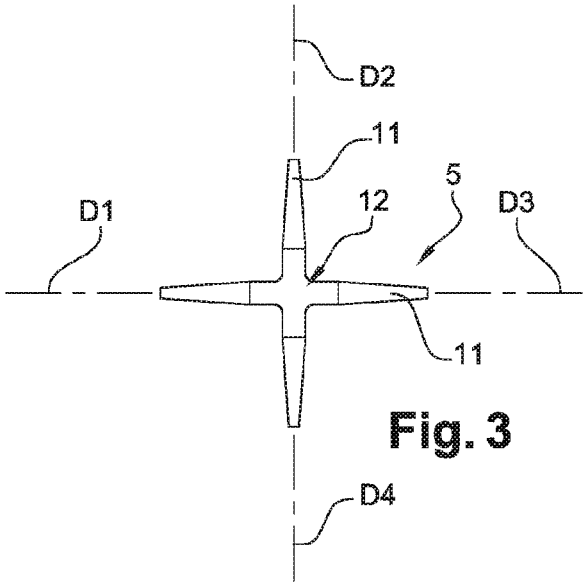
FIG. 3 shows a cross-sectional view of a first applicator member of an applicator according to the invention.

The two applicator members 5 and 6 are held in place by a core 7 that has two arms 8 and 9, that are twisted at least partially together, the applicator members being held between these arms. The two arms may be produced from one and the same metal wire which is folded on itself in the form of a pin before being twisted, as shown in FIG. 2.

In cross section, the diameter of the arms is between 0.3 and 1 mm. The metal wire is made for example of stainless steel. The two arms are for example held in one and the same housing provided at the end of the stem 2, for example by being screwed therein in the hot state.

The second applicator member 6 is formed by bunches of bristles 10 disposed between the two arms. One bristle 10 of the second applicator member extends through the arms so as to protrude on two distinct sides of the core 7. A bristle is generally tubular, having a diameter of between 15 and 35 hundredths of a millimeter. They may for example be solid or hollow. During the twisting of the arms 8 and 9, the bunches of bristles spread out between the arms so as to form a layer of bristles that is approximately homogeneous. This layer of bristles forms the plurality of bristles. Thus, for the second applicator member, it is possible to count between 25 and 50 bristles per turn, i.e. from 25 to 50 ends of bristles counted over 180°.

These bristles 10 of the second applicator member 6 may be identical to one another, or else may be formed by assembling bunches of different types of bristles. Similarly, various operations of shaping the bristles may be carried out when the applicator head is produced, starting from the moment at which the arms are twisted.

The bristles 10 may, for example, be formed in at least two different categories of bristles, the categories differing for example by way of the diameter of the bristles, the shape of their cross section, the manner in which they are formed, their colour or else their individual length measured between their free ends and the core 7. This length may be modified during an operation of shaping the envelope surface of the second applicator member. The bristles 10 are made, for example, of synthetic or natural material, for example of polyamide or of Hytrel®.

It is also possible to subject the bristles 10 to heat treatments, to melting of the ends, to abrasive treatments, or to mechanical impacts, for example in order to form forks or bends.

The first applicator member 5 comprises applicator elements 11 protruding from a body 12. The body 12 may have a circular cross section or some other cross section, for example a cruciform, polygonal or elliptical cross section. It is obtained, for example, by injection-moulding, for example from a thermoplastic elastomeric material, for example styrene-ethylene-butadiene-styrene (SEBS) or a polyester elastomer such as Hytrel®. Preferably, it is produced from a deformable flexible material, for example having a hardness of around 40 Shore, on the basis of a plastic or elastomeric material, and for example from polymer.

The applicator elements 11 are obtained by being moulded from the same material as the body or from a different material, being in this case for example overmoulded onto the body 12. The applicator elements 11 may be separate and independent of the body 12 and be fixed to the latter by any appropriate means, for example by adhesive bonding, flocking, thermal welding, crimping or mechanical assembly, without, however, departing from the scope of the invention.

The first applicator member is preferably produced in one piece, that is to say it is a one-piece component, or in other words it has a unitary character. This implies that it is not formed by joining together a plurality of separate and independent individual pieces, but itself alone consists of a unitary entity. This unitary, one-piece character helps to simplify manufacturing and construction of the applicator 1 in accordance with the invention, this proving to be valuable for the industrialization of manufacturing the instrument 1 and the mechanical strength of the latter.

Advantageously, the body 12 is substantially elongate and has a main elongation axis formed by the axis Y, which is preferably coincident with the longitudinal axis of the applicator head 4.

The applicator elements 11 are disposed on the body 12 before the latter is twisted, so as to extend in at least three different radial directions around said main elongation axis Y, and preferably in at least four different radial directions D1, D2, D3, D4 around said axis Y. In other words, the applicator elements 11 are implanted in at least three different angular positions around the main elongation axis Y, such that they take up a three-dimensional arrangement on the body 12 which has not yet been twisted (illustrated in FIGS. 2 to 5).

Thus, some of these applicator elements extend, starting from the non-twisted body 12, in a first radial direction D1, while other elements extend from this body 12 in a second radial direction D2 which is different from the first radial direction D1, while yet other elements 11 extend in each case in separate third and fourth radial directions D3, D4. In other words, the applicator elements 11 are attached to the body 12 at attachment points which are disposed on the body 12 such that when the body 12 is in the non-twisted state, said attachment points belong to at least three different radii in relation to the main elongation axis Y. Such a three-dimensional distribution of the applicator elements 11 on and around the body 12 makes it possible to obtain an optimized makeup effect which combines the advantages of conventional twisted mascara brushes with those associated with moulded brushes.

Advantageously, the applicator elements 11 are arranged on the body 12, before the latter is twisted, in at least four different radial directions D1, D2, D3, D4 which are equally distributed around said main elongation axis Y. The applicator elements extend approximately perpendicularly to the axis Y.

The applicator elements 11 of the first applicator member may have a different pitch or the same pitch along the main elongation axis Y of the applicator head, the pitch denoting the distance between two consecutive applicator elements of a row, formed by the elements protruding in a main radial direction. In a further variant, the pitch may vary along a row. Each row may have an identical number of applicator elements or alternatively a different number of applicator elements.

Within one or more rows, the bases of the applicator elements may be aligned or arranged in staggered rows.

In the examples illustrated, the applicator elements 11 have a constant height but, in variants which are not shown, the height of the applicator elements 8 may vary, in a monotonous or non-monotonous manner, along the core. The height of the applicator elements may be between 0.5 and 8 mm, and is preferably 4 mm. The width at the base of the applicator elements 11 is advantageously between about 0.2 and 3 mm, preferably between about 0.3 and 1 mm.

Of course, the invention is not limited to a particular structure of the element applicator element or elements, said structure being essentially dictated by the consistency of the product to be applied and the characteristics of the makeup result that are sought.

The degree of twisting of the core 7 in the region of the first applicator member is for example between 0 and 5 turns, in particular between 1 and 3 turns. The expression "twisting of the first applicator member" should be understood as meaning a rotation of the cross section of the first applicator member about its longitudinal axis. The degree of twisting of the applicator member denotes the angle through which the section has turned. The degree of twisting of the core varies along the length of the latter; it is less twisted around the first applicator member than around the second applicator member, the degree of twisting of the core being at a maximum in a portion of the core where there is no applicator member. The degree of twisting of the core 7 varies along its length, and in particular increases from its free end 13 towards its proximal end held in the stem 2. Specifically, the first applicator member 5 is located in the region of a distal end 14 of the applicator head 4, opposite a proximal end 15 of this head in relation to a longitudinal axis Y.

Along the axis Y, the following are found in succession, starting from the distal end 14 of the applicator in the direction of the end 2*b* of the stem where it is attached by way of its proximal end 15: the first applicator member 5, and then the second applicator member 6. Preferably, there is no covering along the axis Y in the region of the arms 8 and 9 between the two applicator members.

As can be seen in FIGS. 4*a* and 4*b*, at least one applicator element extends in the region of, or even beyond, a free end 13 of the core 7. In FIG. 4*a*, within one row, there are two applicator elements 11' which protrude from the free end 13. In particular, along the axis Y, the base of these applicator elements 11' is located beyond the free end 13. It is these applicator elements 11' which then form the distal end of the applicator 1. In the example shown, this free end 13 is formed by the bend in the metal wire which has been folded over on itself before being twisted. Preferably, a second row, diametrically opposite the one which has the elements 11', is configured in the same way. This configuration makes it possible to hide the free end 13 of the core 7.

In a variant, FIG. 4*b*, the applicator elements 111, which protrude beyond the free end 13, are arranged on the outer perimeter of the body 12 in order to each have different angular positions in relation to the axis Y. These different angular positions are successive and thus make it possible to have elements perpendicular to the axis Y, and/or others that form an acute angle with this axis Y, and/or advantageously at least one element 115 having an extent substantially parallel to the axis Y. In the example in FIG. 4*b*, each row has two elements 111' at 90° to the axis Y, three other elements 112, 113 and 114 respectively at an angle of around 17°, 45° and 72°, and finally a last element 115 parallel to the axis Y.

The core 7 has a twisted portion in the clockwise direction on moving from the proximal end 15, attached to the stem, towards the free end 13. In a variant, this twisted portion may also be in the anticlockwise direction. In a further variant, the twisting of the core takes place in two different directions in two separate successive portions. These portions may correspond to the portions where the first and the second applicator member are respectively held.

The overall length, along the axis Y, of the applicator head 4 is for example between 10 and 40 mm, preferably between 20 and 30 mm. Preferably, the portion of the core holding the first applicator member represents less than half, or even less than a third, preferably less than a quarter of this overall length.

As a result of the twisting of the core, spiralling of the applicator members is obtained, and helical expansion both of the bristles and of the applicator elements successively along the axis Y.

The invention is not limited to a particular orientation and/or dimensioning of the applicator elements, which may adopt any shape desired by a person skilled in the art.

In order to produce such an applicator head, the body 12, in its non-twisted state, is inserted between the two arms 8 and 9, as are the bunches of bristles 10, as illustrated in FIG. 2. In the examples illustrated in FIGS. 2, 4 and 5, the arms 8 and 9 are initially substantially straight, rectilinear and parallel to one another, while the body 12 is initially non-twisted when it is slid between said arms. A torsional force is then exerted simultaneously on the two arms, thereby causing twisting in a double helix around the axis Y, each helix corresponding to one of the arms. The twisting of the core 7 simultaneously causes the body 12 and the bristles 10 to be captured, and imparts on them their helical expansion.

The expression "comprising a" should be understood as being synonymous with "comprising at least one", unless specified to the contrary.

The expression "for applying a product to the eyelashes" should be understood as being synonymous with "for applying a product to the eyelashes and/or the eyebrows", unless specified to the contrary.

The invention claimed is:

1. Applicator for applying a product to the eyelashes, comprising a core, wherein the core comprises two arms that are twisted together along at least part of their length, the core successively holding, along a longitudinal axis, by clamping between said two arms, a first applicator member, located at a distal end of the applicator, produced in one piece and having a plurality of applicator elements, and a second applicator member comprising a plurality of bristles;

wherein the first applicator member comprises a body that is substantially elongate and has a main elongation axis, which is coincident with the longitudinal axis of the arms;

wherein the first applicator member is produced by injection-moulding thermoplastic material, which is or is not a thermoplastic elastomer, or an elastomer other than a thermoplastic elastomer, or else by casting a resin.

2. The applicator of claim 1, wherein the first applicator member comprises a body and said applicator elements extending from this body, such that the applicator elements extend in at least two separate radial directions in relation to the body, prior to insertion into the core.

3. The applicator of claim 2, wherein, for at least one radial direction, at least one applicator element extends in the region of, or even beyond, a free end of the core.

4. The applicator of claim 1, wherein said applicator elements expand helically on account of the twisting of the core about this first applicator member.

5. The applicator of claim 1, wherein in that the degree of twisting of the core varies along the length of the core.

6. A packaging and application device comprising:

an applicator comprising a core, wherein the core comprises two arms that are twisted together along at least part of their length, the core successively holding, along a longitudinal axis, by clamping between said two arms, a first applicator member, located at a distal end of the applicator, produced in one piece and having a plurality of applicator elements, and a second applicator member comprising a plurality of bristles;

wherein the first applicator member comprises a body that is substantially elongate and has a main elongation axis, which is coincident with the longitudinal axis of the arms;

wherein the first applicator member is produced by injection-moulding thermoplastic material, which is or is not a thermoplastic elastomer, or an elastomer other than a thermoplastic elastomer, or else by casting a resin, and a cosmetic product to be applied to the eyelashes, in particular mascara.

7. The device of claim 6, wherein the applicator is held by a proximal end at the end of a stem such that the first applicator member is located in the region of a distal end, opposite the proximal end, in relation to a longitudinal axis of the applicator.

8. A method for manufacturing an applicator comprising:

a core, a first applicator member, and a second applicator member, wherein the core comprises two arms, positioning the first and the second applicator member on at least one of the arms, successively along the longitudinal axis of this arm, twisting the core in order to bring about spiralling of the arms and spiralling of at least one of the first and the second applicator member, the core successively holding, along a longitudinal axis, by clamping between said two arms, the first applicator member, located at a distal end of the applicator, produced in one piece and having a plurality of applicator elements, and the second applicator member comprising a plurality of bristle;

wherein the first applicator member comprises a body that is substantially elongate and has a main elongation axis, which is coincident with the longitudinal axis of the arms.

9. The method of claim 8, wherein the core is twisted so as to bring about spiralling of the arms along the entire length where the arms enclose the first and the second applicator member.

* * * * *